US011738230B2

(12) United States Patent
Rosenow

(10) Patent No.: US 11,738,230 B2
(45) Date of Patent: Aug. 29, 2023

(54) PULL ANGLE SELF-ADJUSTING ENDLESS ROPE TRAINER

(71) Applicant: Torque Fitness, LLC, Coon Rapids, MN (US)

(72) Inventor: Charles J. Rosenow, Ramsey, MN (US)

(73) Assignee: TORQUE FITNESS, LLC, Coon Rapids, MN (US)

( * ) Notice: Subject to any disclaimer, the term of this patent is extended or adjusted under 35 U.S.C. 154(b) by 53 days.

(21) Appl. No.: 17/449,108

(22) Filed: Sep. 28, 2021

(65) Prior Publication Data

US 2022/0105379 A1 Apr. 7, 2022

Related U.S. Application Data

(60) Provisional application No. 63/087,554, filed on Oct. 5, 2020.

(51) Int. Cl.

| | |
|---|---|
| ***A63B 21/018*** | (2006.01) |
| ***A63B 21/015*** | (2006.01) |
| ***A63B 21/005*** | (2006.01) |
| ***A63B 21/012*** | (2006.01) |
| ***A63B 21/00*** | (2006.01) |

(Continued)

(52) U.S. Cl.

CPC ..... *A63B 21/018* (2013.01); *A63B 7/045* (2013.01); *A63B 21/015* (2013.01); *A63B 23/12* (2013.01); *A63B 23/1209* (2013.01); *A63B 21/0051* (2013.01); *A63B 21/0058* (2013.01); *A63B 21/00058* (2013.01); *A63B 21/00069* (2013.01); *A63B 21/012* (2013.01); *A63B 21/4035* (2015.10); *A63B 21/4043* (2015.10)

(58) Field of Classification Search

CPC ..... A63B 7/04; A63B 7/045; A63B 21/00058; A63B 21/00069; A63B 21/0051; A63B 21/0058; A63B 21/012; A63B 21/015; A63B 21/018; A63B 21/156; A63B 21/4035; A63B 21/00047; A63B 23/12; A63B 23/1209

See application file for complete search history.

(56) References Cited

U.S. PATENT DOCUMENTS

| | | | |
|---|---|---|---|
| 3,506,262 | A | 8/1967 | Wade |
| 3,599,974 | A | 8/1971 | Price |
| 3,782,718 | A | 1/1974 | Saylor |

(Continued)

FOREIGN PATENT DOCUMENTS

| | | | |
|---|---|---|---|
| AU | 2002338009 | A1 | 9/2003 |
| DE | 19851511 | A1 | 5/2000 |

(Continued)

*Primary Examiner* — Megan Anderson

(74) *Attorney, Agent, or Firm* — SHERRILL LAW OFFICES, PLLC

(57) ABSTRACT

An endless rope trainer that includes an upright frame, a drive roller supported a distance above ground on the frame, an endless rope entrained around the drive roller, and a means of applying resistance to rotation of the drive roller. A pair of guide rollers are provided proximate the drive roller. The guide rollers pivot together as a unit about the axis of the drive roller independently of the drive roller for maintaining a constant wrap angle of contact of the endless rope on the drive roller regardless of pull angle on the endless rope.

12 Claims, 27 Drawing Sheets

(51) Int. Cl.
*A63B 23/12* (2006.01)
*A63B 7/04* (2006.01)

(56) References Cited

U.S. PATENT DOCUMENTS

| | | | |
|---|---|---|---|
| 4,270,750 | A | 6/1981 | Malcolm |
| 4,512,570 | A | 4/1985 | Tardivel |
| 4,944,510 | A | 7/1990 | Brady |
| 5,060,938 | A | 10/1991 | Hawley, Jr. |
| 5,076,574 | A | 12/1991 | Johnson, Jr. |
| 5,380,258 | A | 1/1995 | Hawley, Jr. |
| 5,484,360 | A | 1/1996 | Haber et al. |
| 6,261,208 | B1 | 7/2001 | Carson, Jr. |
| 6,569,065 | B1 | 5/2003 | Menold et al. |
| 7,018,323 | B1 | 3/2006 | Reynolds et al. |
| 7,086,991 | B2 | 8/2006 | Williams et al. |
| 7,303,506 | B1 | 12/2007 | Reynolds et al. |
| 7,387,593 | B2 | 6/2008 | Ryan et al. |
| 7,789,812 | B2 | 9/2010 | Anderson et al. |
| 7,811,204 | B2 | 10/2010 | Popescu |
| 8,021,285 | B2 | 9/2011 | Kushnir |
| 8,025,608 | B2 | 9/2011 | Popescu |
| 9,604,087 | B2 | 3/2017 | Brown et al. |
| 9,724,552 | B2 | 8/2017 | Schumacher |
| 10,016,645 | B1 | 6/2018 | Reynolds et al. |
| 10,525,301 | B2 | 1/2020 | Hsu |
| 10,857,404 | B2 * | 12/2020 | Small ..... A63B 21/157 |
| 2007/0270287 | A1 | 11/2007 | McDonnell |
| 2019/0175972 | A1 | 6/2019 | Small |

FOREIGN PATENT DOCUMENTS

| | | | |
|---|---|---|---|
| DE | 2003 11 330 | U1 | 11/2003 |
| DE | 202010003344 | U1 | 6/2010 |
| DE | 10 2009 012127 | B4 | 2/2011 |
| DE | 102010021379 | A1 | 12/2011 |
| DE | 202014100859 | U1 | 6/2014 |
| DE | 202013012092 | U1 | 4/2015 |
| DE | 202018103091 | U1 | 7/2018 |
| EP | 1128876 | | 10/2003 |
| EP | 1857148 | A1 | 11/2007 |
| EP | 2021081 | | 2/2009 |
| EP | 2462995 | B1 | 8/2013 |
| EP | 2326393 | B1 | 9/2016 |
| EP | 2994205 | B1 | 11/2017 |
| FR | 2420983 | | 10/1979 |
| FR | 2 682 604 | A1 | 4/1993 |
| GB | 2341806 | B | 3/2000 |
| WO | 00/27486 | | 5/2000 |
| WO | 03/076021 | A1 | 9/2003 |
| WO | 2007/140086 | A2 | 12/2007 |
| WO | 2010/019330 | A2 | 2/2010 |
| WO | 2010/039228 | A2 | 4/2010 |
| WO | 2014/166463 | A1 | 10/2014 |

* cited by examiner

PULL ANGLE SELF-ADJUSTING ENDLESS ROPE TRAINER

BACKGROUND

Endless rope exercise devices have long been a staple stationary exercise machine. A variety of endless rope exercise machines have been developed, such as those described in U.S. Pat. Nos. 3,599,974, 3,782,718, 5,060,938, 5,076,574, 5,380,258, 5,484,360, 6,261,208, 7,018,323, 7,086,991, 7,303,506, 7,387,593, 7,811,204, 8,021,285, 8,025,608, 9,604,087, 10,016,645 and 10,525,301. These exercise machines, while suitable for their intended purpose, suffer various drawbacks including specifically but not exclusively a lack of flexibility in pull angle and/or slippage of the rope off one or more of the rollers/pulleys when the rope is pulled.

Accordingly, a substantial need exists for an improved endless rope exercise device that overcomes these drawbacks.

SUMMARY OF THE INVENTION

The invention is an endless rope trainer. The endless rope trainer includes an upright frame, a dynamic head assemblage supported a distance above ground on the frame, and an endless rope entrained around a drive roller on the dynamic head assemblage. The dynamic head assemblage includes (i) a drive shaft defining a drive axis, (ii) a drive roller keyed to the drive shaft, (iii) a pair of guide rollers proximate the drive roller configured and arranged for pivoting together as a unit about the axis of the drive shaft independently of the drive roller, and (iv) a means of applying resistance to rotation of the drive roller.

In a preferred embodiment the frame preferably includes a base, a stanchion extending vertically from the base, and a boom extending horizontally from the stanchion, with the dynamic head assemblage attached to the distal end of the boom.

DETAILED DESCRIPTION OF THE INVENTION INCLUDING A PREFERRED EMBODIMENT

Nomenclature Table

Figure 1:
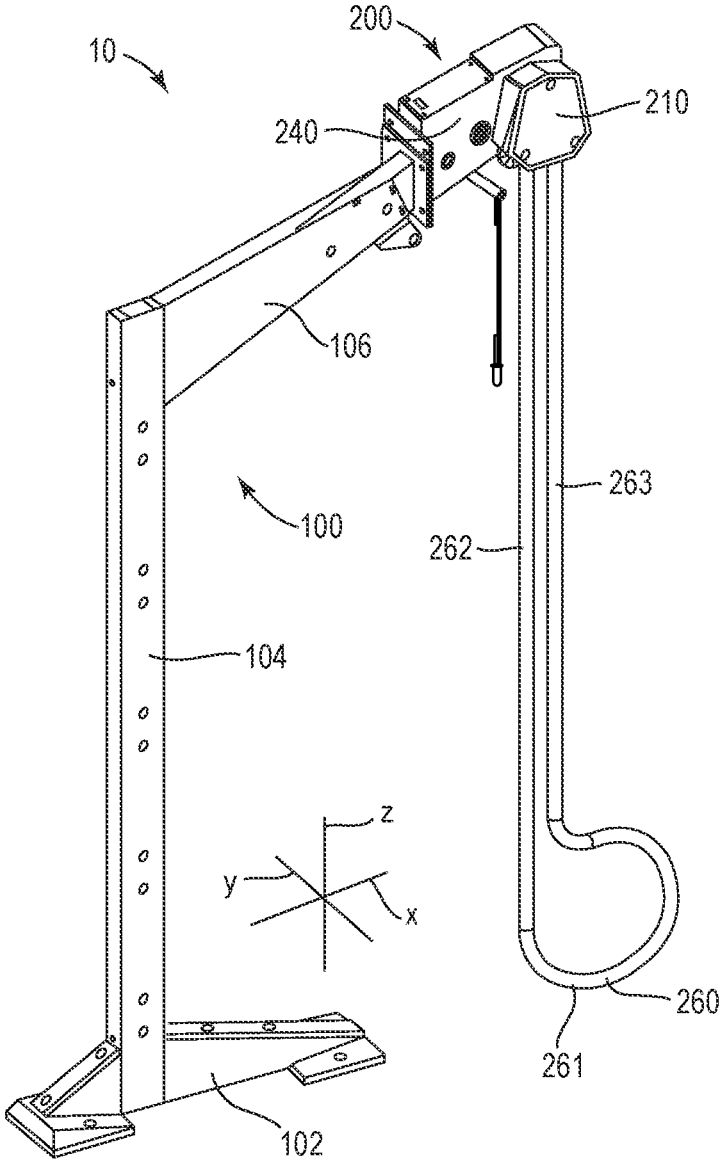
FIG. 1 is a perspective view of one embodiment of the invention with a relaxed rope.
Figure 2:
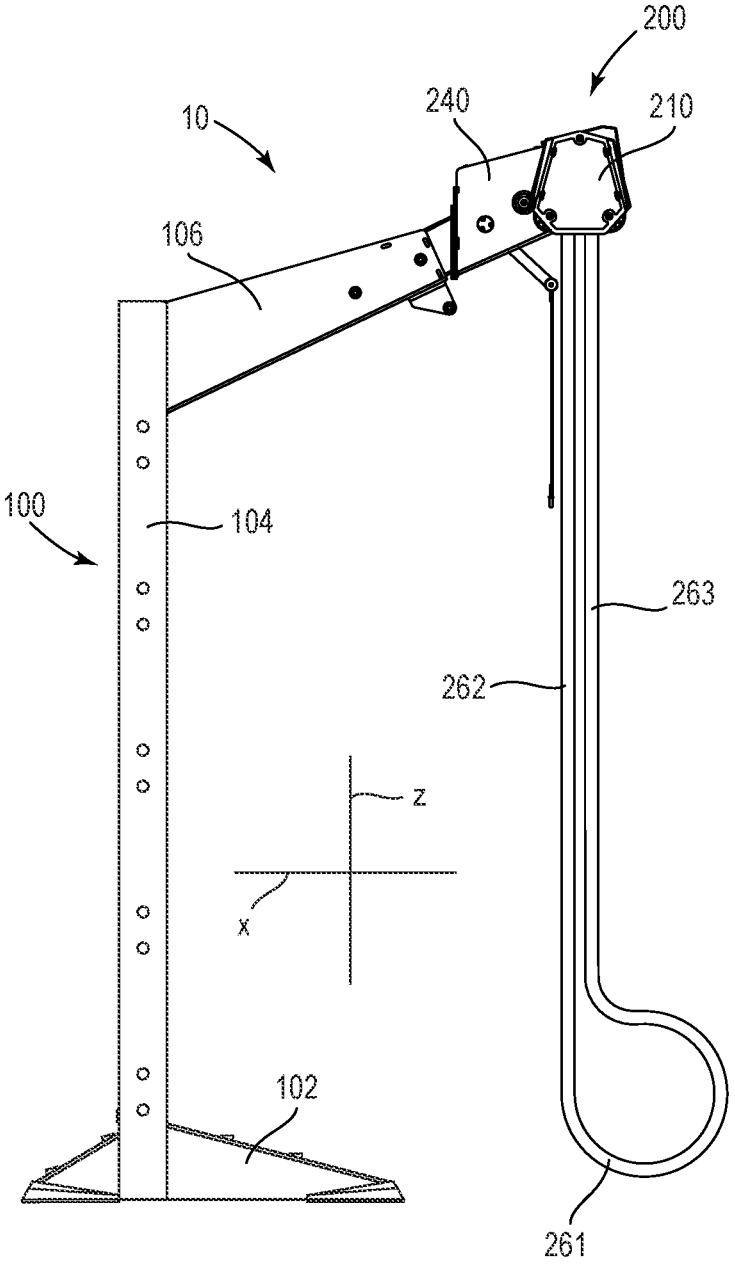
FIG. 2 is a side view of the invention depicted in FIG. 1.
Figure 3:
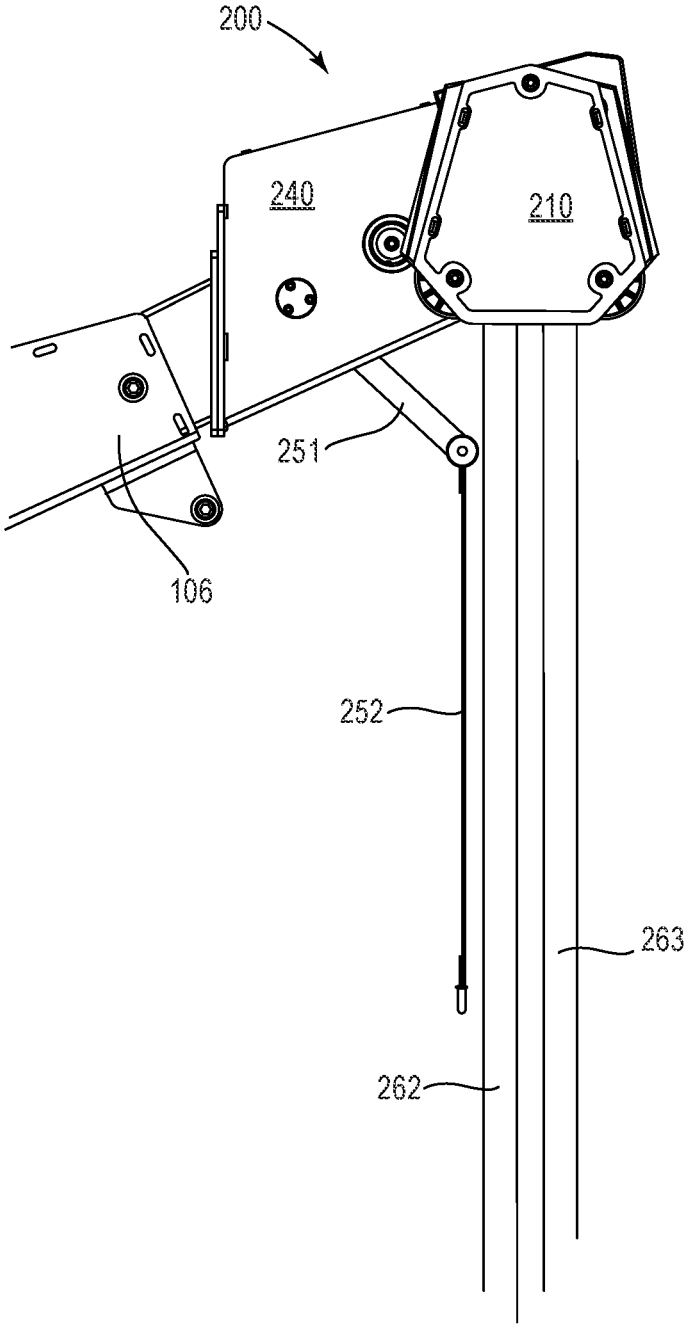
FIG. 3 is an enlarged side view of the dynamic head assemblage portion of the invention depicted in FIG. 2.

| Ref. No. | Description |
|---|---|
| 10 | Pull Angle Self-Adjusting Endless Rope Trainer (ERT) |
| 100 | Frame |
| 102 | Base |
| 104 | Stanchion |
| 106 | Boom |
| 200 | Dynamic Head Assemblage |
| 210 | Roller Assembly |
| 211 | Drive Roller |
| 212 | Slack Side Guide Roller |
| 213 | Tension Side Guide Roller |
| 225 | Outermost Circumferential Periphery of Guide Rollers |
| 227 | Roller Assembly Housing |

-continued

| Nomenclature Table | |
|---|---|
| Ref. No. | Description |
| 229 | Longitudinal Gap Between Guide Rollers |
| 240 | Resistance Assembly |
| 242 | Brake Mechanism |
| 244 | Drive Shaft |
| 245 | Drive Axis |
| 247 | Resistance Assembly Housing |
| 250 | Resistance Adjustment Mechanism |
| 251 | Resistance Adjustment Lever |
| 252 | Pull Chain for Adjusting Resistance |
| 260 | Endless Rope |
| 261 | Free End of Endless Rope |
| 262 | Slack Side of Endless Rope |
| 263 | Tension Side of Endless Rope |
| α | Wrap Angle of Contact |
| x | Longitudinal Axis |
| y | Lateral Axis |
| z | Transverse Axis |

Pull Angle Self-Adjusting Endless Rope Trainer 10

Referring to FIGS. 1, 2, 7, 8 and 13, the invention is an endless rope trainer 10 that includes an upright frame 100, a dynamic head assemblage 200, a resistance assembly 240 and an endless rope 260. The dynamic head assemblage 200 self-rotates to maintain proper alignment of the rollers (not collectively numbered) in the dynamic head assemblage 200 with the pull angle of the endless rope 260.

Referring to FIGS. 1, 2, 7 and 8, the upright frame 100 includes a longitudinally x and laterally y extending base 102 in contact with ground, a transversely z/vertically extending stanchion 104, and preferably a longitudinally x/horizontally extending boom 106.

The dynamic head assemblage 200 is supported a distance above ground on the frame 100, preferably at a transverse z height that positions the drive axis 245 of the dynamic head assemblage 200 at least eight feet above ground.

Referring to FIGS. 5, 6, 11, 12, 13 and 14-27 the dynamic head assemblage 200 includes a roller assembly 210 with (i) a drive roller 211, (ii) a slack side guide roller 212 for guiding incoming endless rope 260 onto the drive roller 211, and (iii) a tension side guide roller 213 for guiding endless rope 260 as it disengages from the drive roller 211.

The drive roller 211 is keyed to a laterally y extending drive shaft 244 for rotation about a laterally y extending drive axis 245. The drive roller 211 preferably has a diameter measured at an axial midplane of the drive roller 211 of between 3 and 12 inches.

The guide rollers 212 and 213 are longitudinally x spaced a fixed distance from one another to define a fixed distance longitudinal x gap 229 between the outermost circumferential periphery 225 of the guide rollers 212 and 213. This longitudinal gap 229 is preferably less than the diameter of the drive roller 211 measured at an axial midplane of the drive roller 211, and most preferably sized to provide and maintain a wrap angle of contact a of the endless rope 260 on the drive roller 211 of at least 200°.

Figure 4:
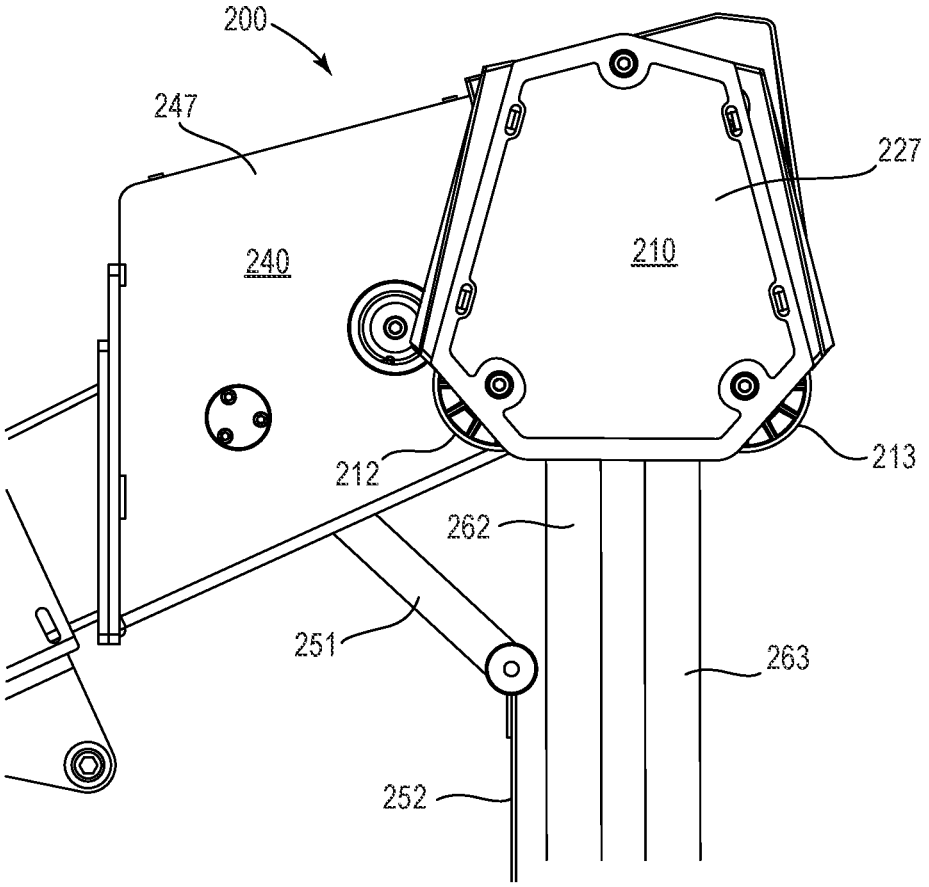
FIG. 4 is a further enlarged side view of the dynamic head assemblage portion of the invention depicted in FIG. 3.
Figure 5:
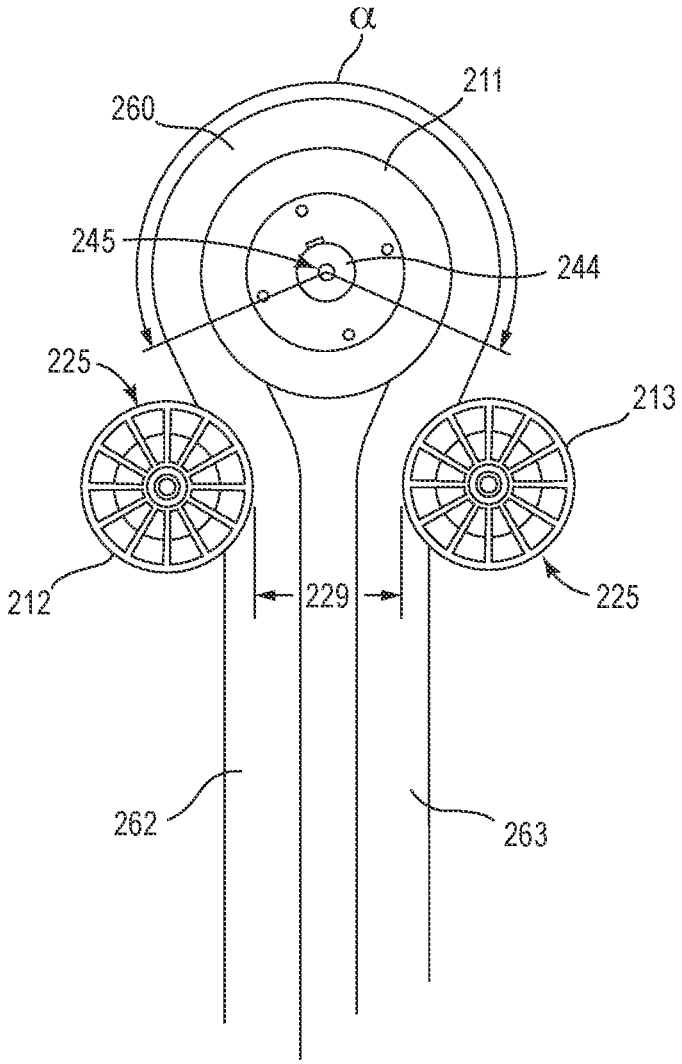
FIG. 5 is a side view of the drive and guide roller components of the dynamic head assemblage depicted in FIG. 4.
Figure 6:
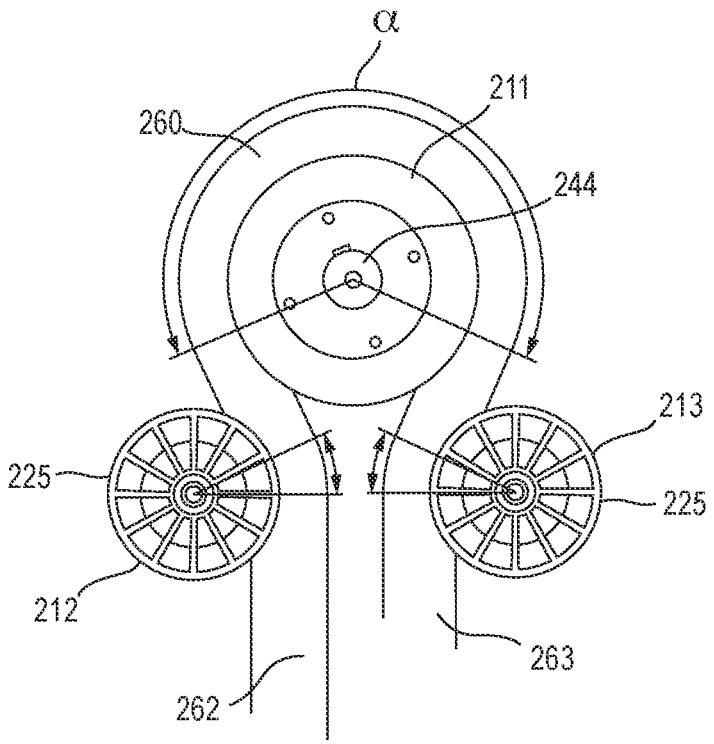
FIG. 6 is a side view of the drive and guide roller components of the dynamic head assemblage depicted in FIG. 5 including an illustration of the contact arc between the rope and each of the drive and guide rollers.
Figure 7:
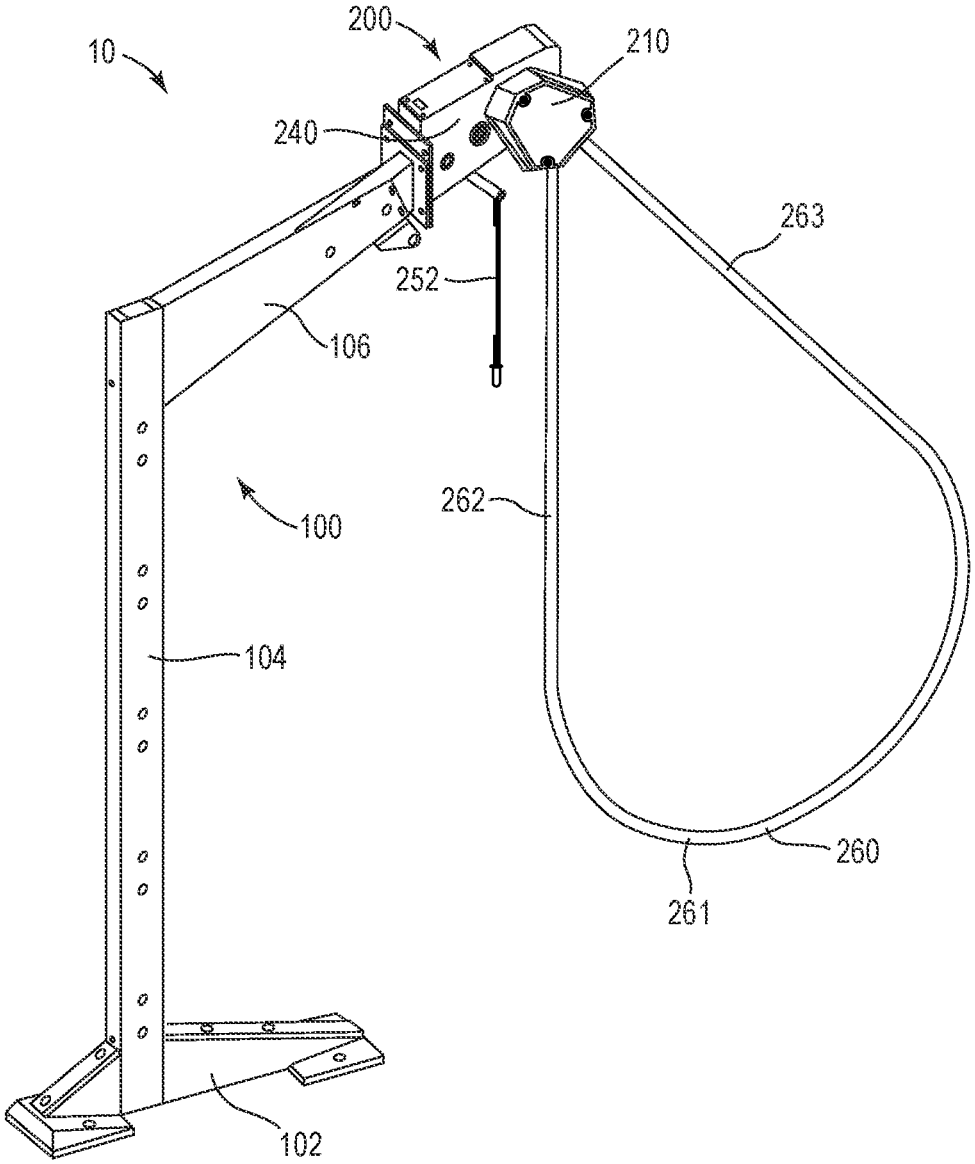
FIG. 7 is a perspective view of the invention depicted in FIG. 1, but with the tension side of the rope pulled at an angle of approximately 40° away from the stanchion relative to vertical.
Figure 8:
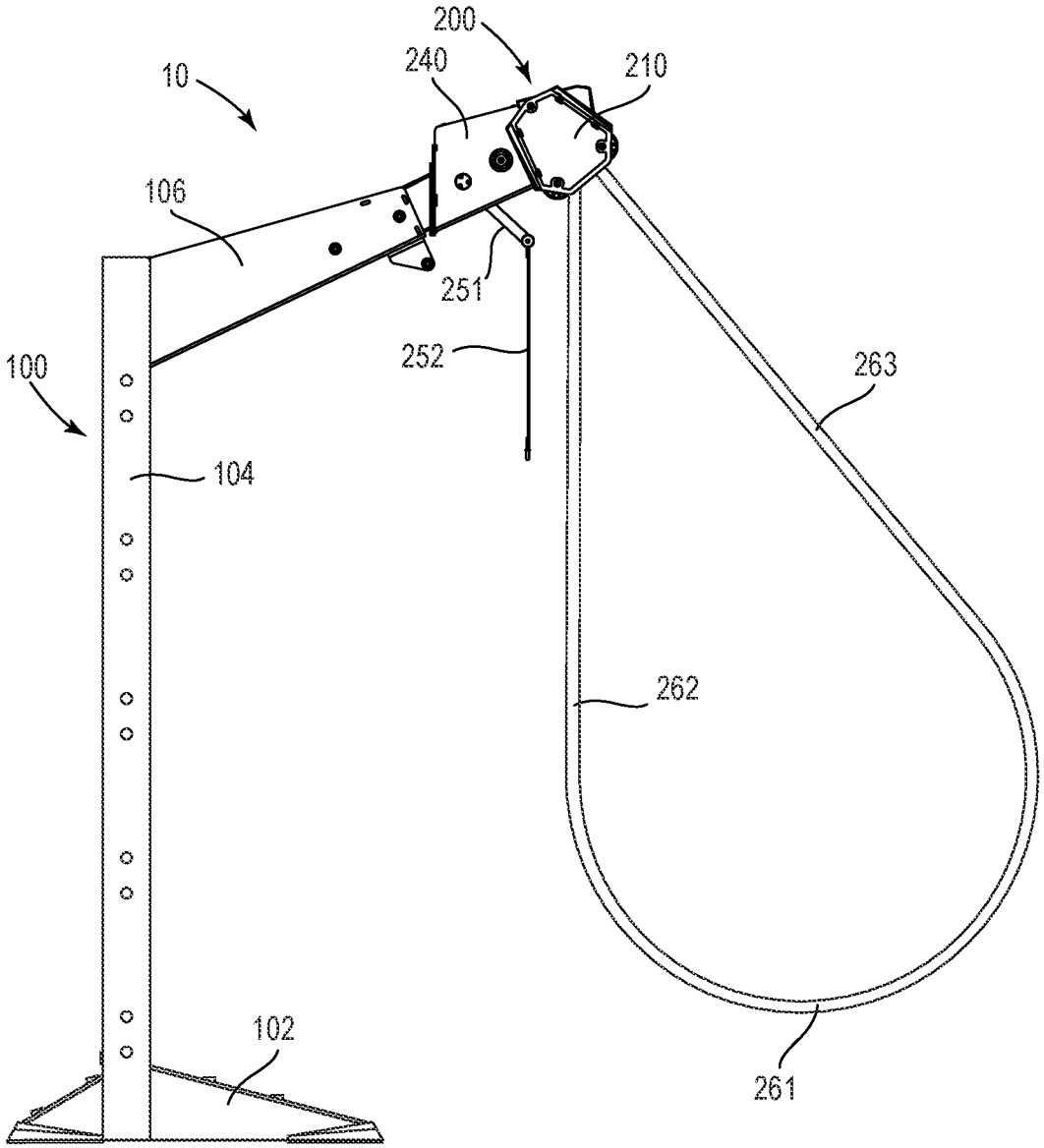
FIG. 8 is a side view of the invention depicted in FIG. 7.
Figure 9:
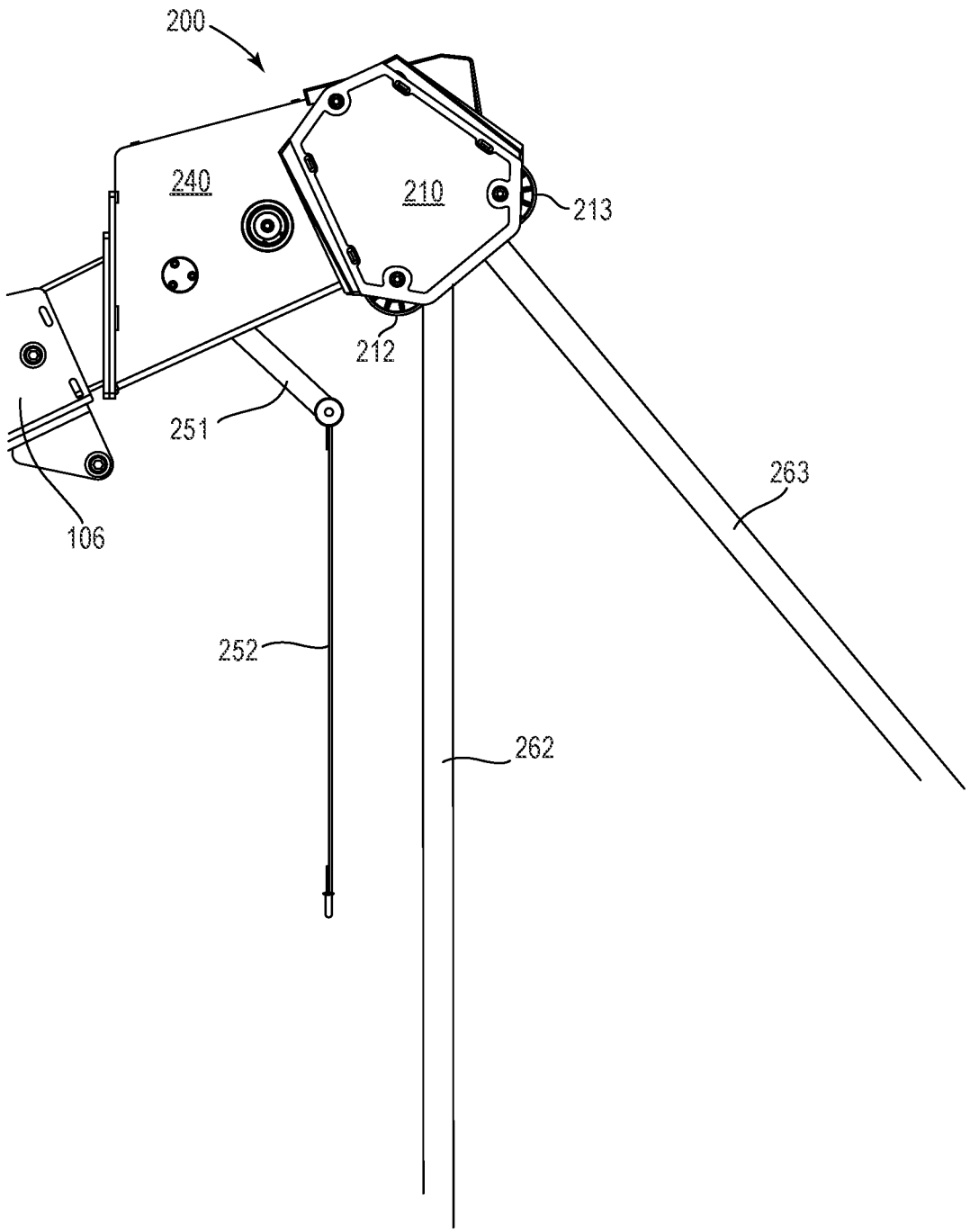
FIG. 9 is an enlarged side view of the dynamic head assemblage portion of the invention depicted in FIG. 8.
Figure 10:
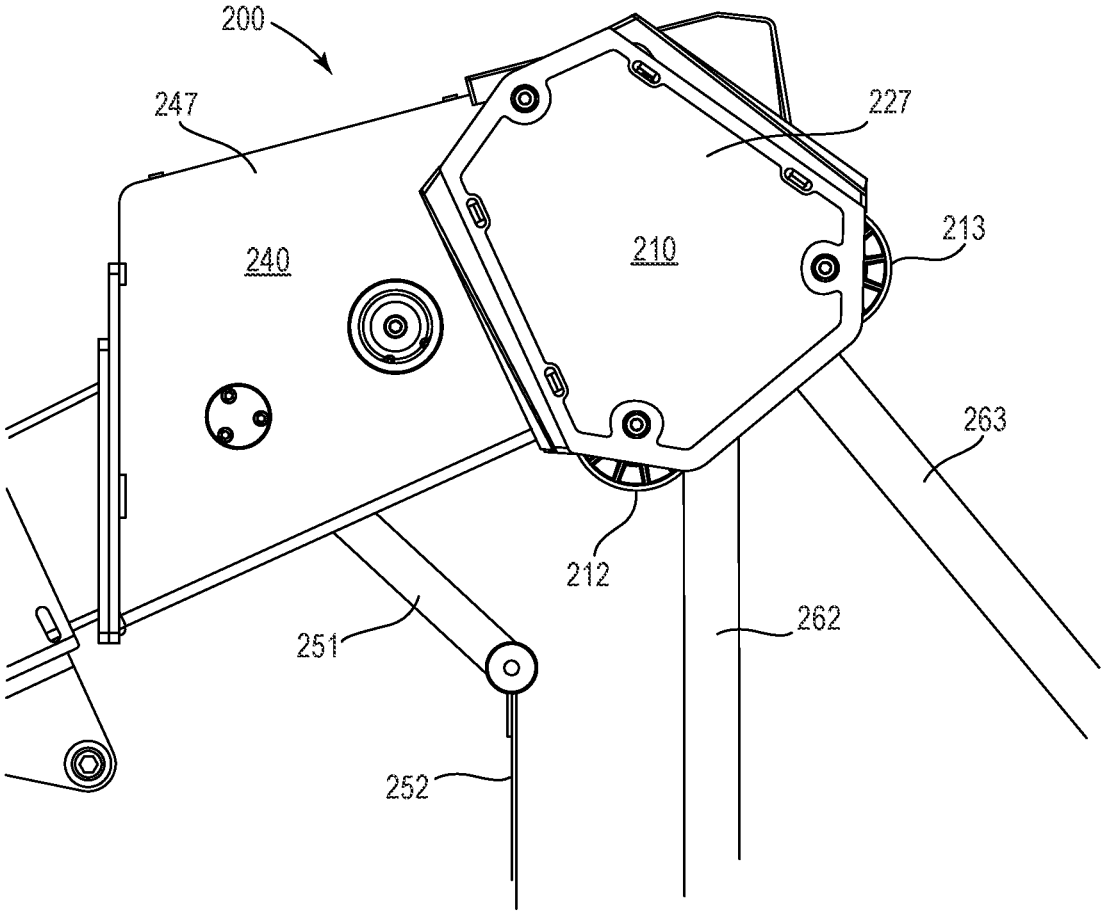
FIG. 10 is a further enlarged side view of the dynamic head assemblage portion of the invention depicted in FIG. 9.
Figure 11:
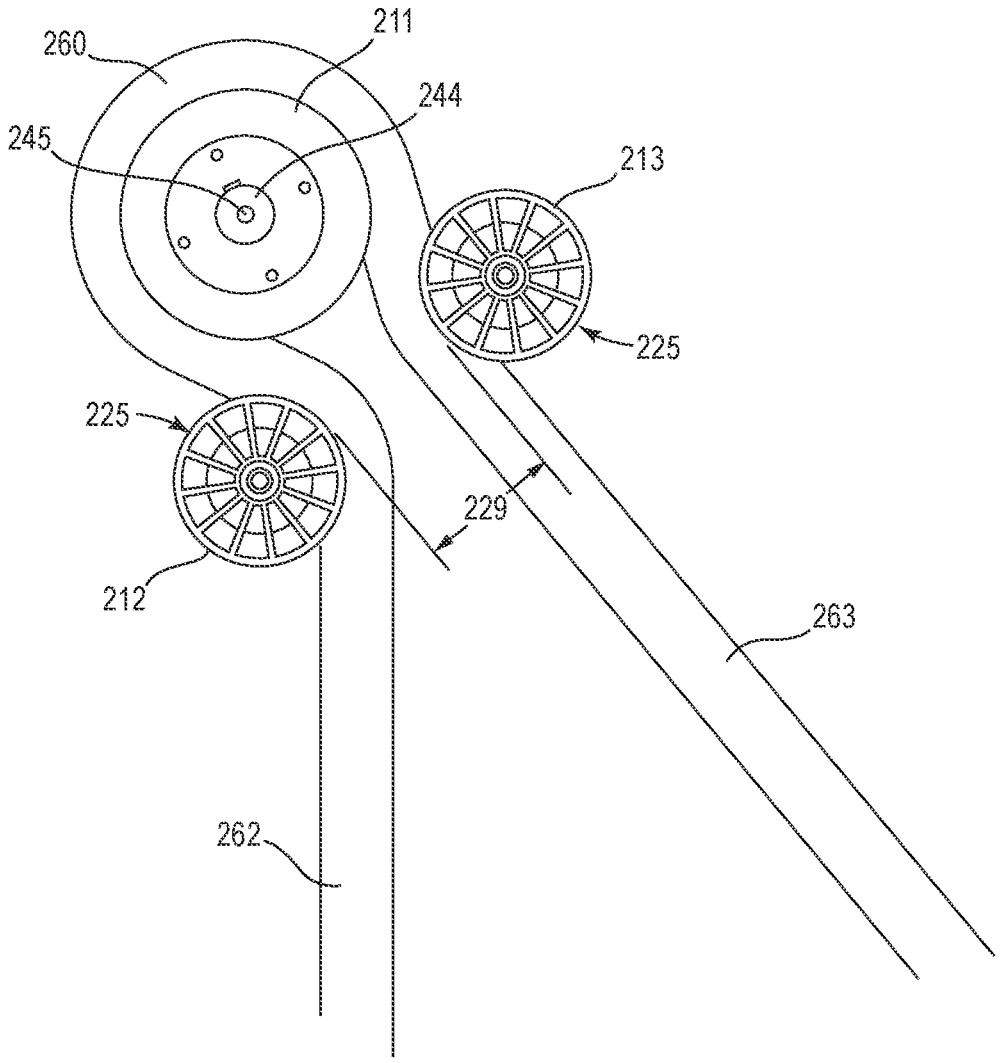
FIG. 11 is a side view of the drive and guide roller components of the dynamic head assemblage depicted in FIG. 10.
Figure 12:
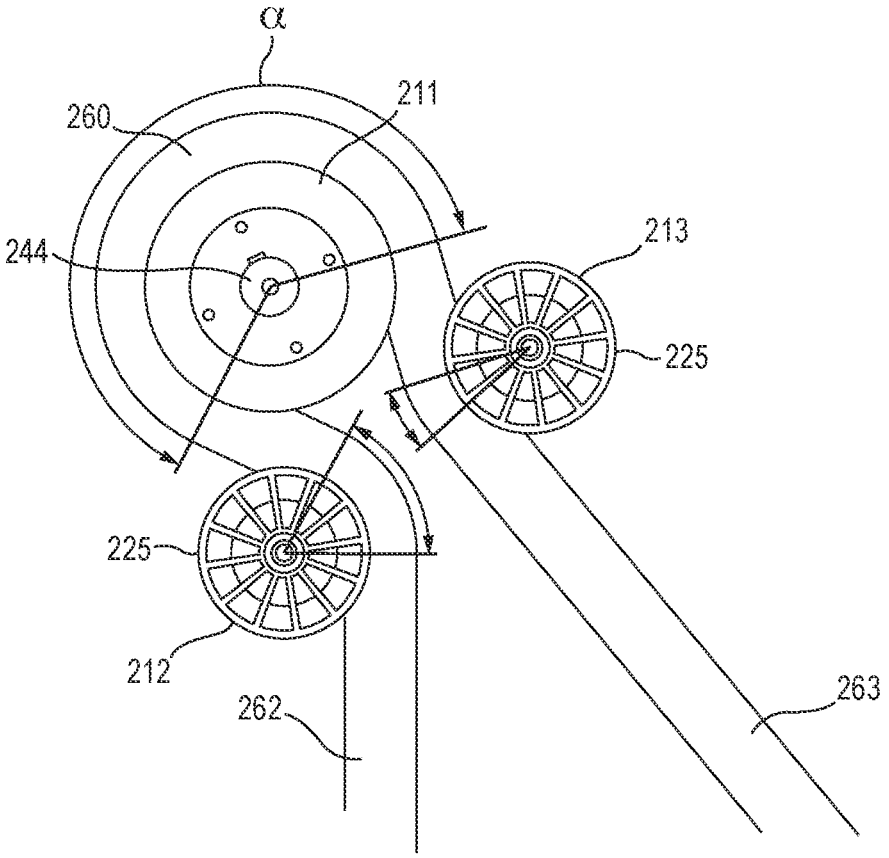
FIG. 12 is a side view of the drive and guide roller components of the dynamic head assemblage depicted in FIG. 11 including an illustration of the contact arc between the rope and each of the drive and guide rollers.
Figure 13:
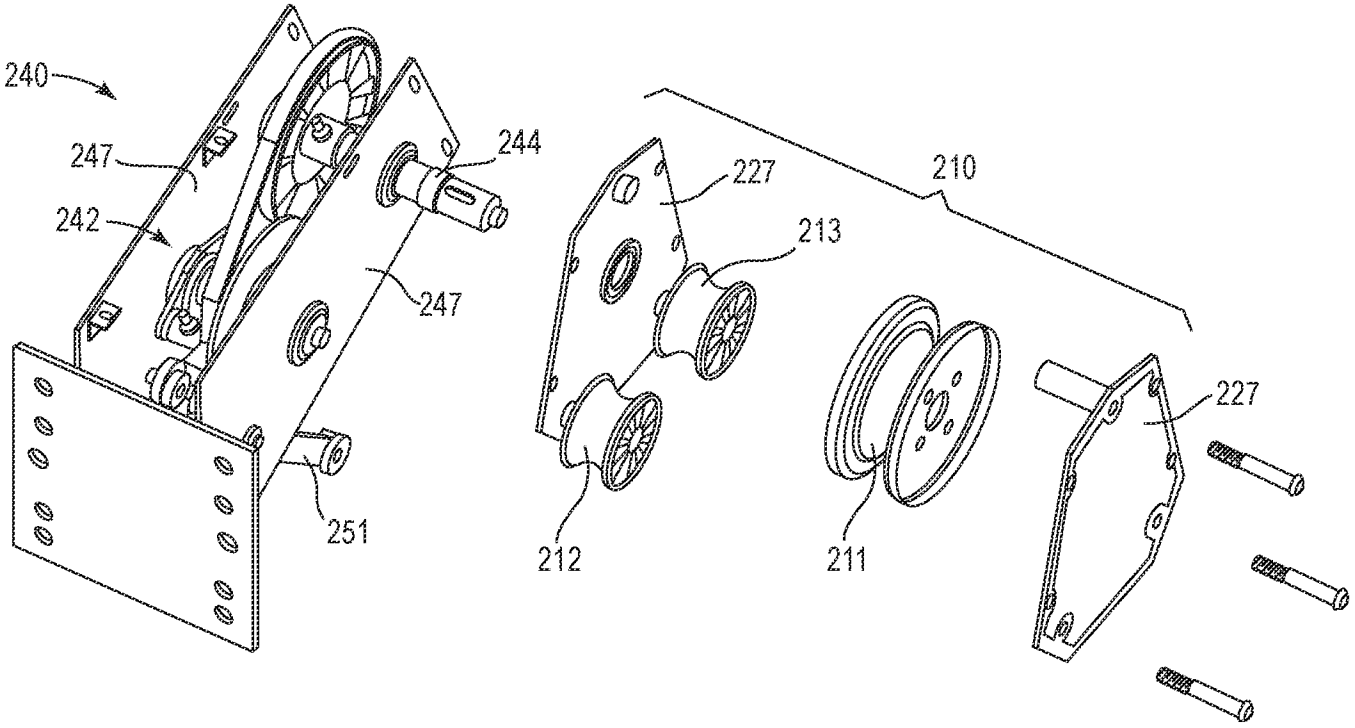
FIG. 13 is an exploded perspective view of the dynamic head assemblage portion of the invention depicted in FIG. 1.
Figure 14:
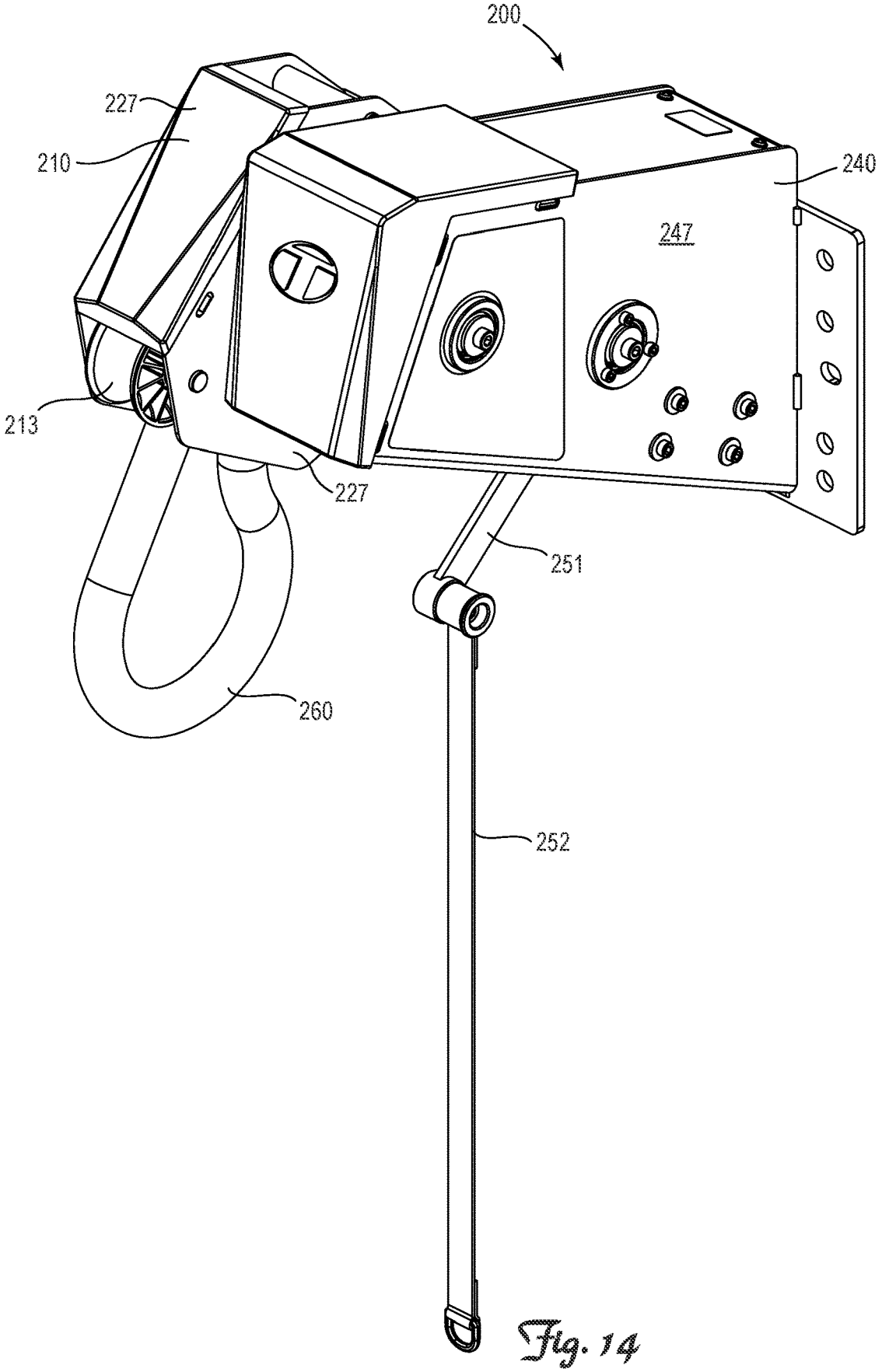
FIG. 14 is a perspective view of the dynamic head assemblage portion of the invention depicted in FIG. 1.
Figure 15:
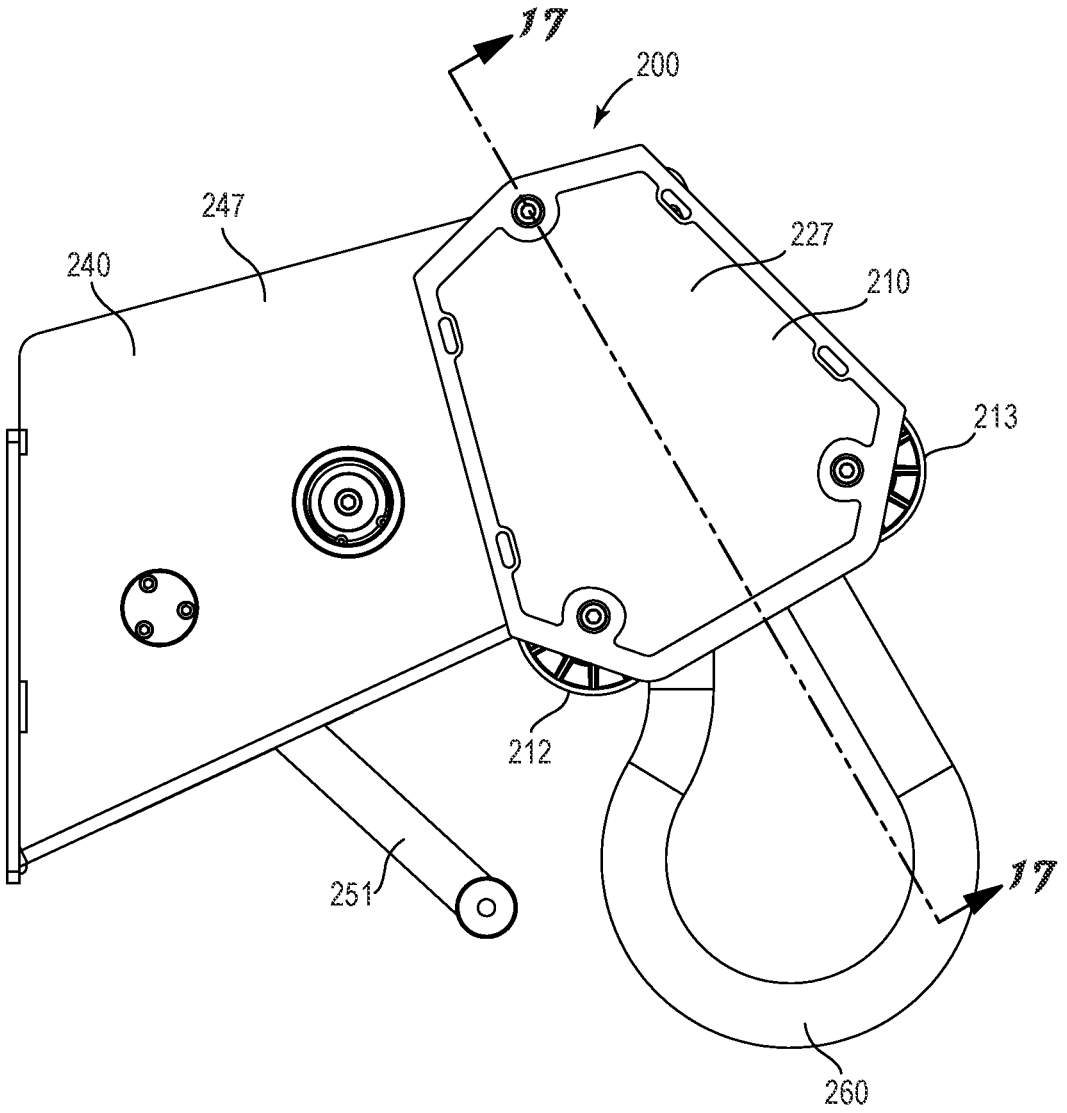
FIG. 15 is a left-side view of the dynamic head assemblage portion of the invention depicted in FIG. 14.
Figure 16:
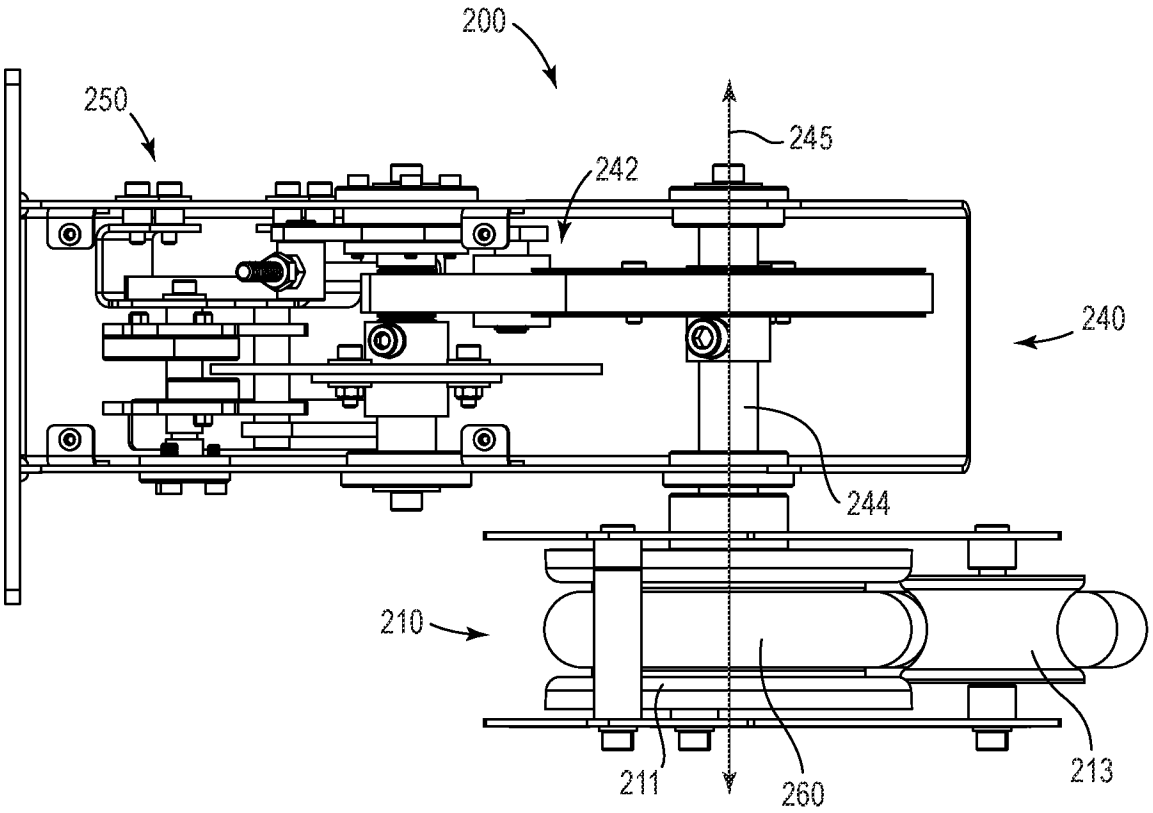
FIG. 16 is a top view of the dynamic head assemblage portion of the invention depicted in FIG. 14 with portions of the housing removed to facilitate viewing of the internal components.
Figure 17:
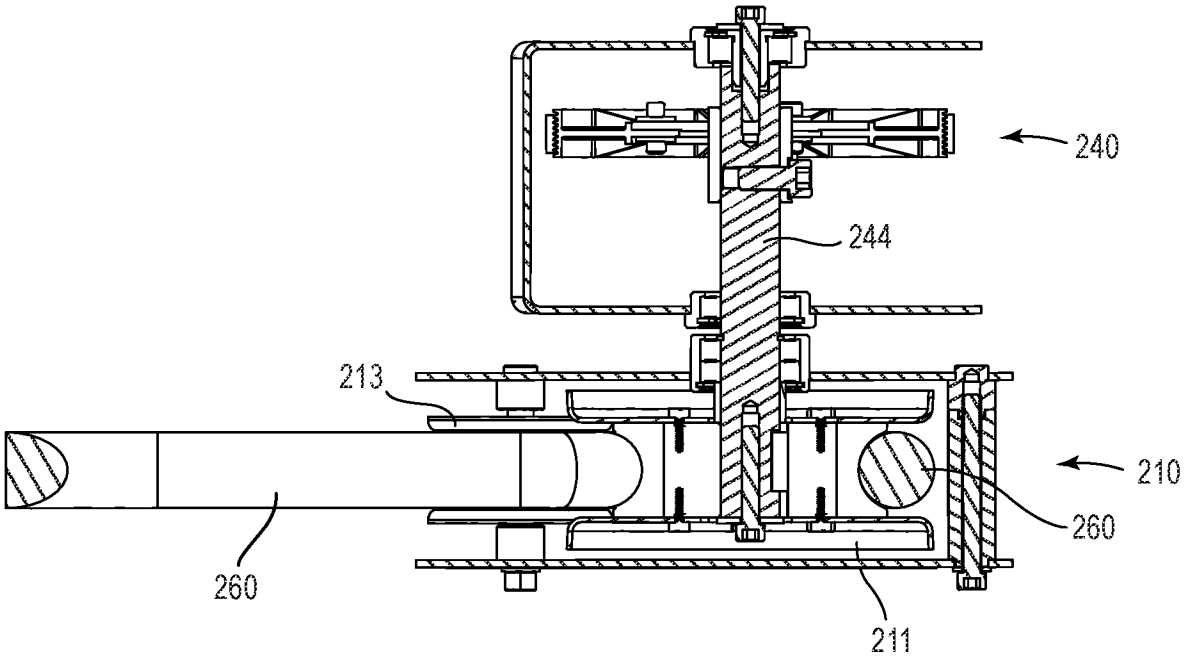
FIG. 17 is a cross-sectional view of the dynamic head assemblage portion of the invention depicted in FIG. 15 taken along line 17-17.
Figure 18:
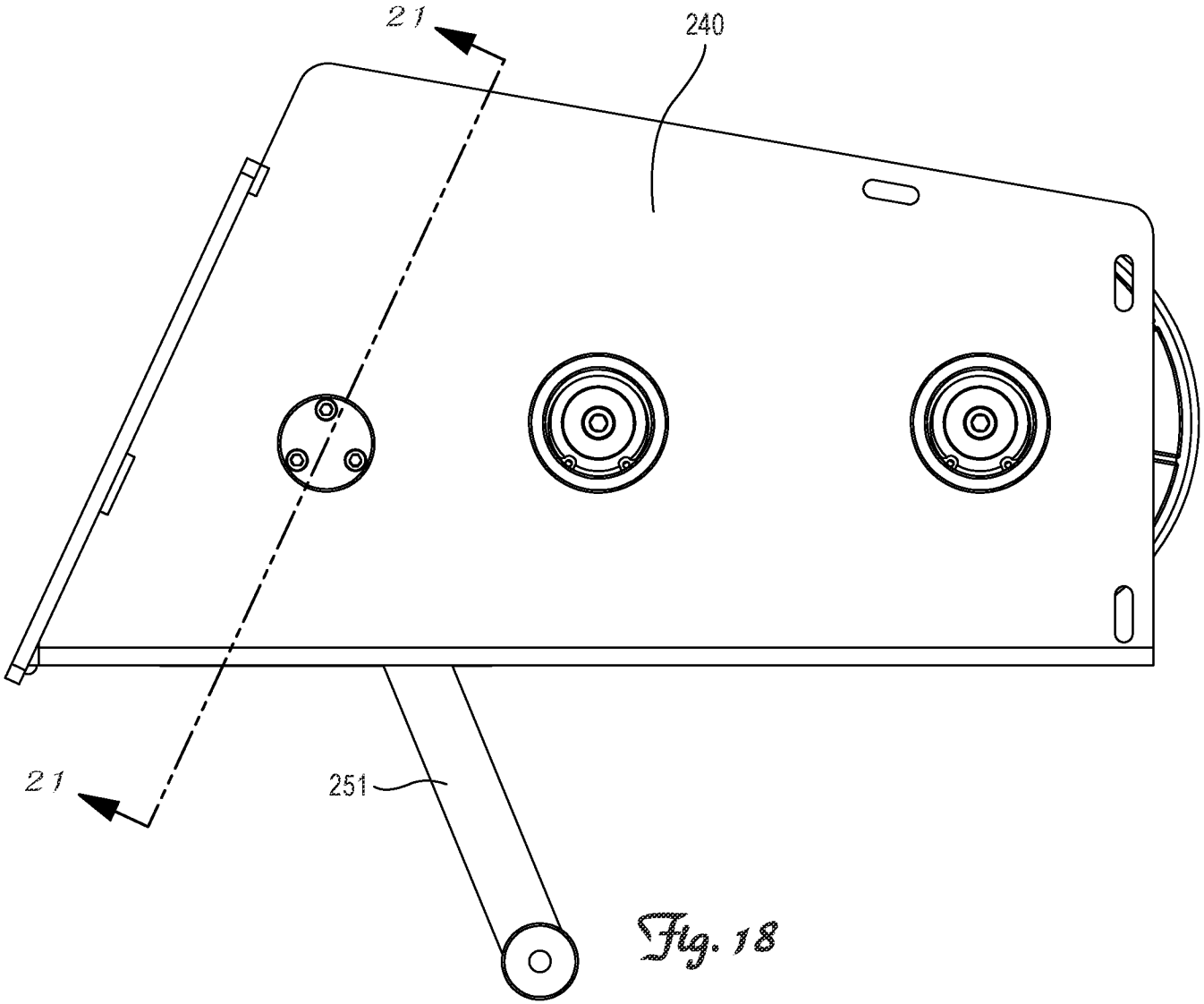
FIG. 18 is a left-side view of the resistance assembly portion of the dynamic head assemblage portion depicted in FIG. 14.
Figure 19:
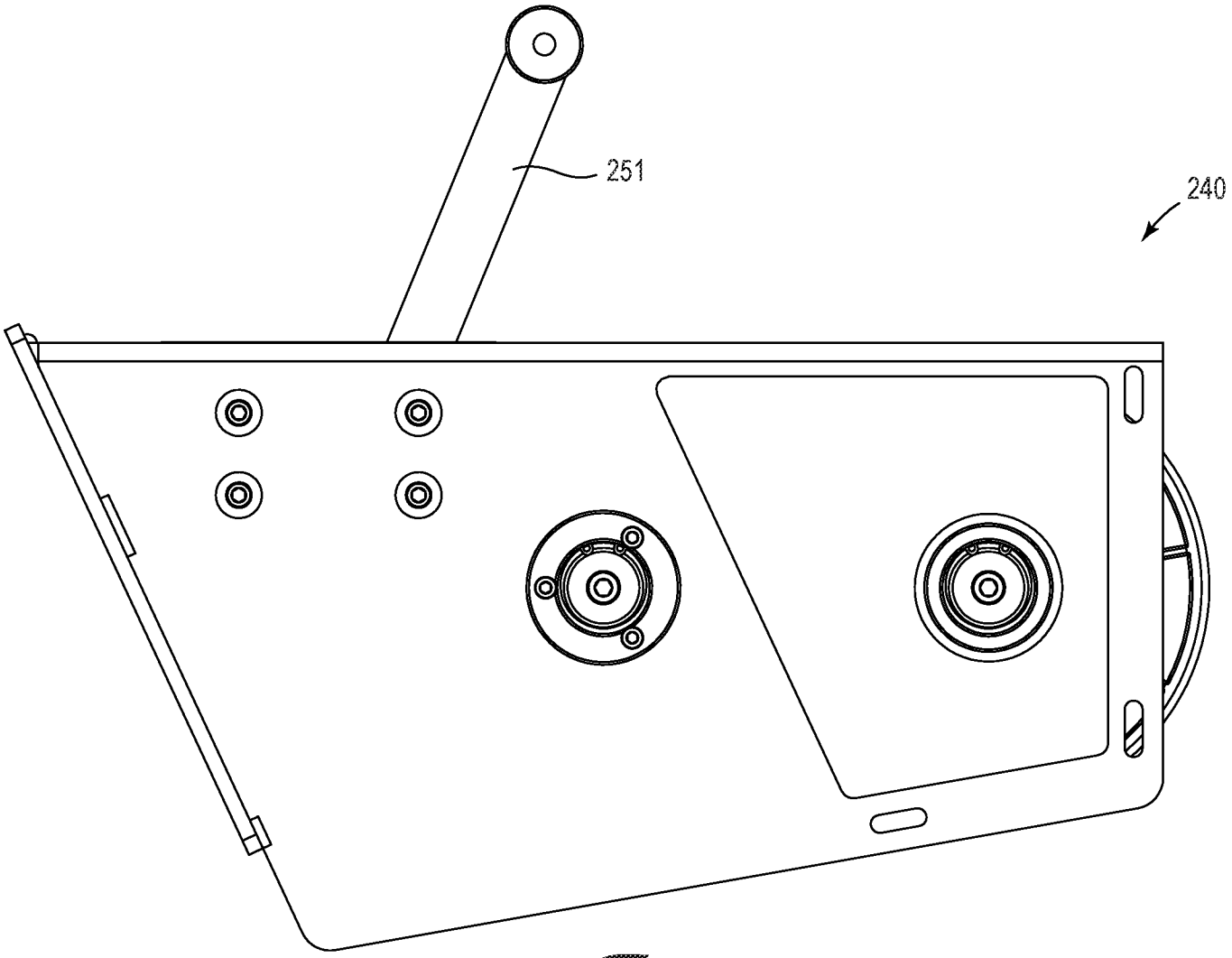
FIG. 19 is a right-side view of the resistance assembly portion of the dynamic head assemblage portion depicted in FIG. 14.
Figure 20:
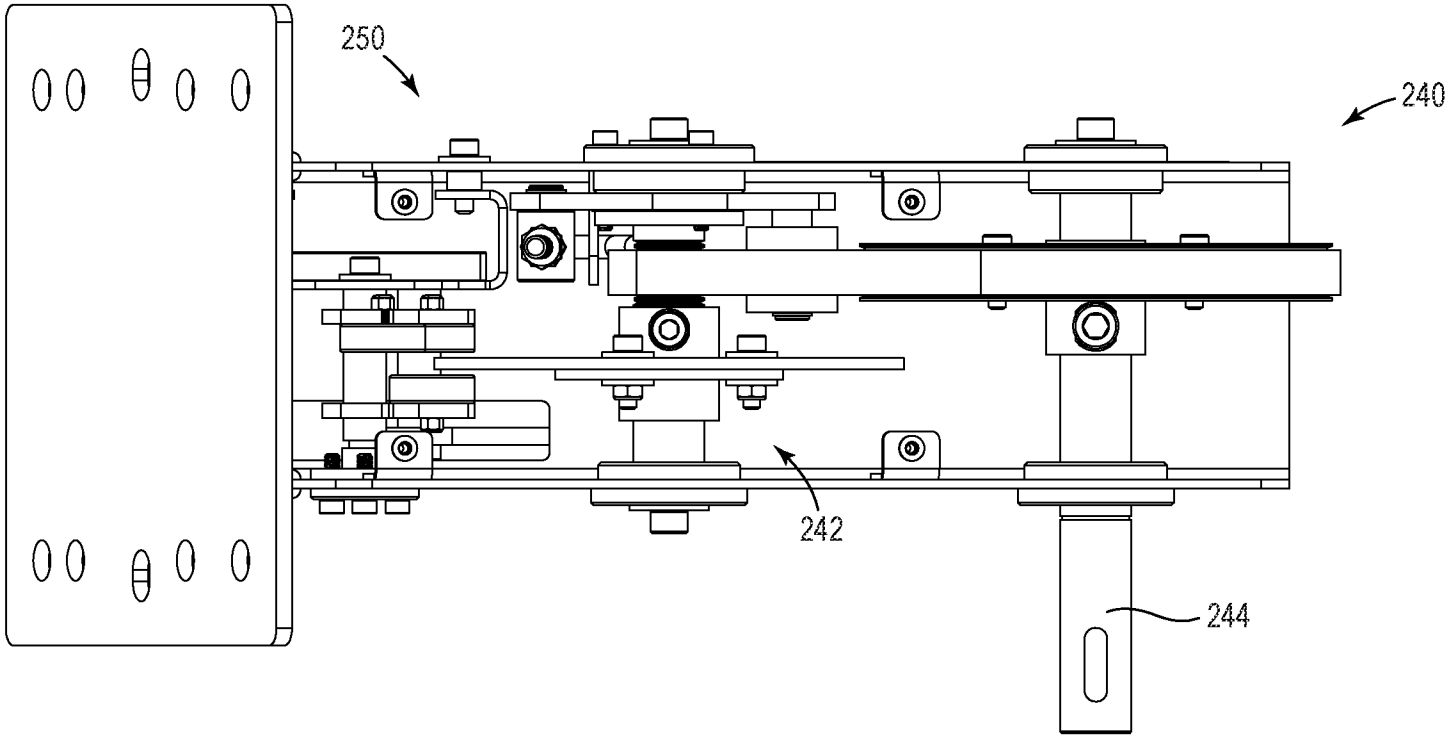
FIG. 20 is a top view of the resistance assembly portion of the dynamic head assemblage portion depicted in FIG. 14 with portions of the housing removed to facilitate viewing of the internal components.
Figure 21:
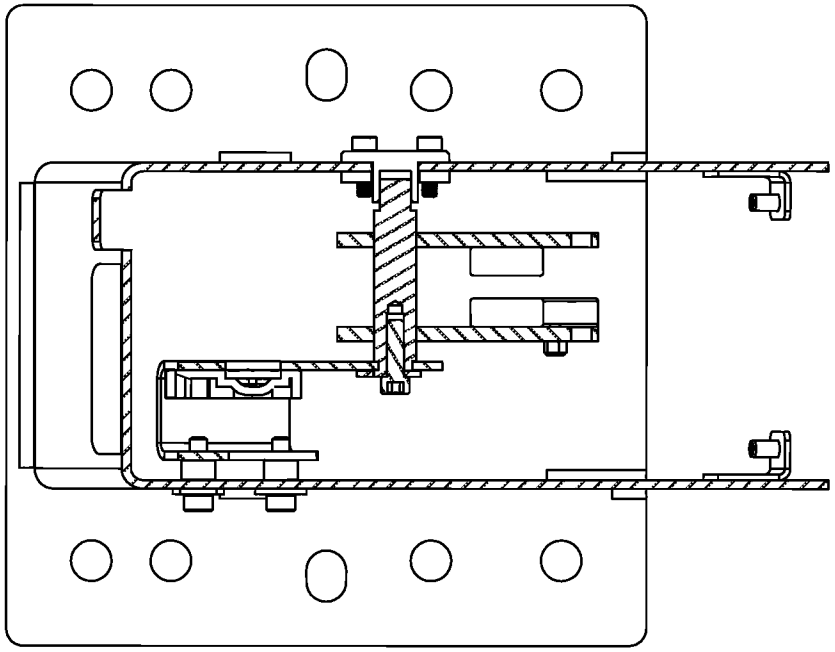
FIG. 21 is a cross-sectional view of the resistance assembly portion of the dynamic head assemblage portion depicted in FIG. 18 taken along line 21-21.
Figure 22:
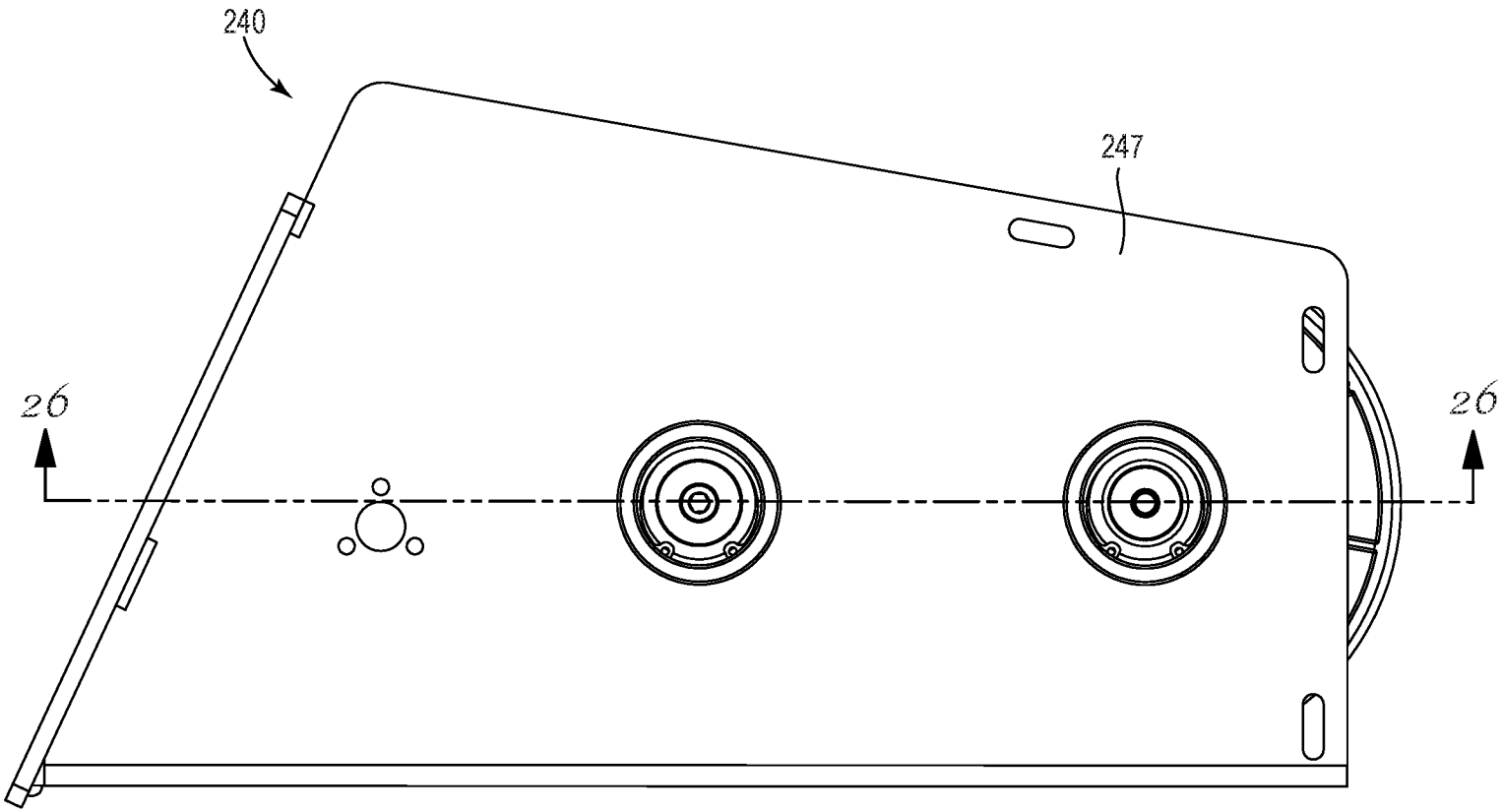
FIG. 22 is a left-side view of the resistance assembly portion depicted in FIG. 18 sans the resistance adjustment feature.
Figure 23:
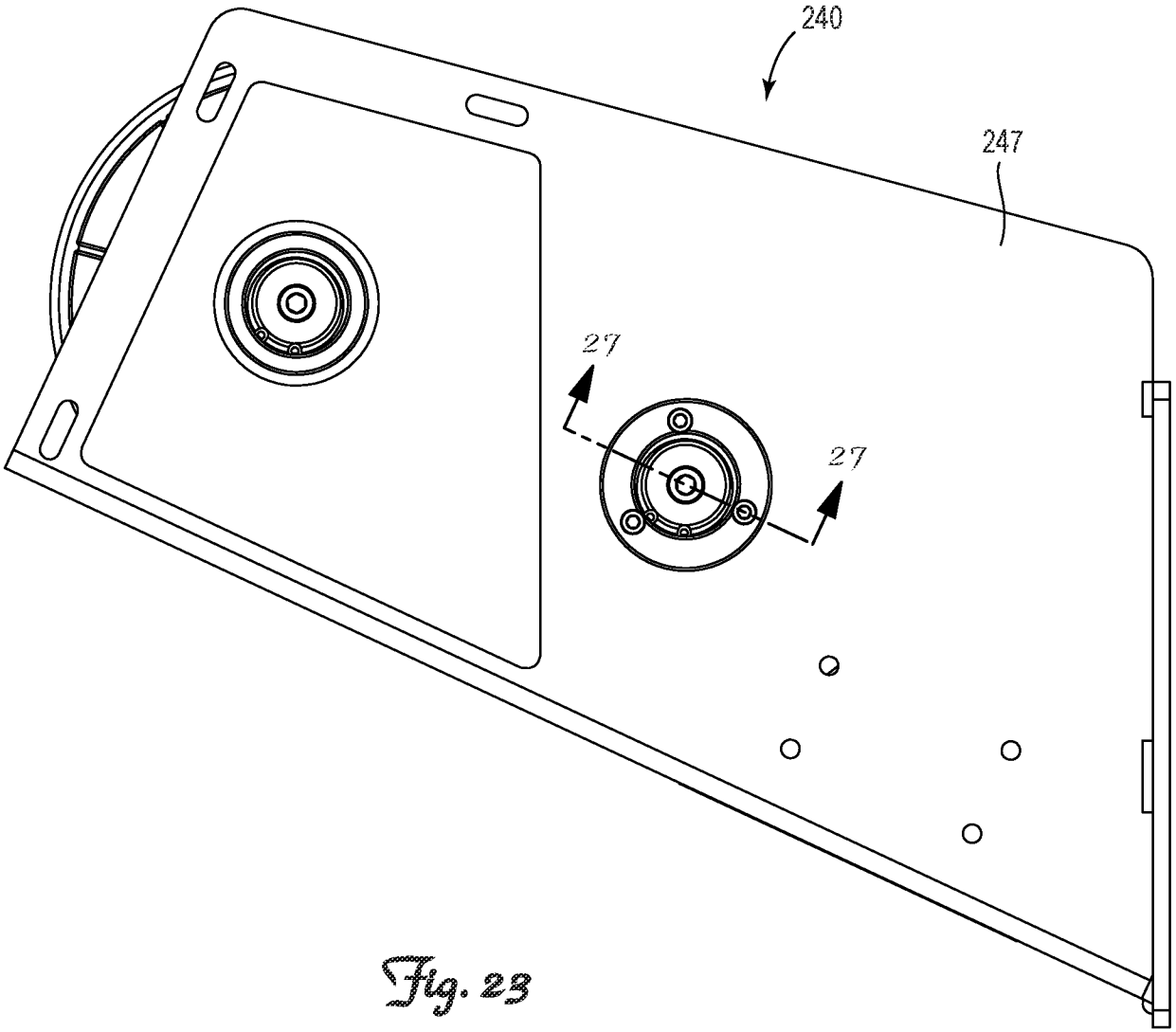
FIG. 23 is a right-side view of the resistance assembly portion depicted in FIG. 18 sans the resistance adjustment feature.
Figure 24:
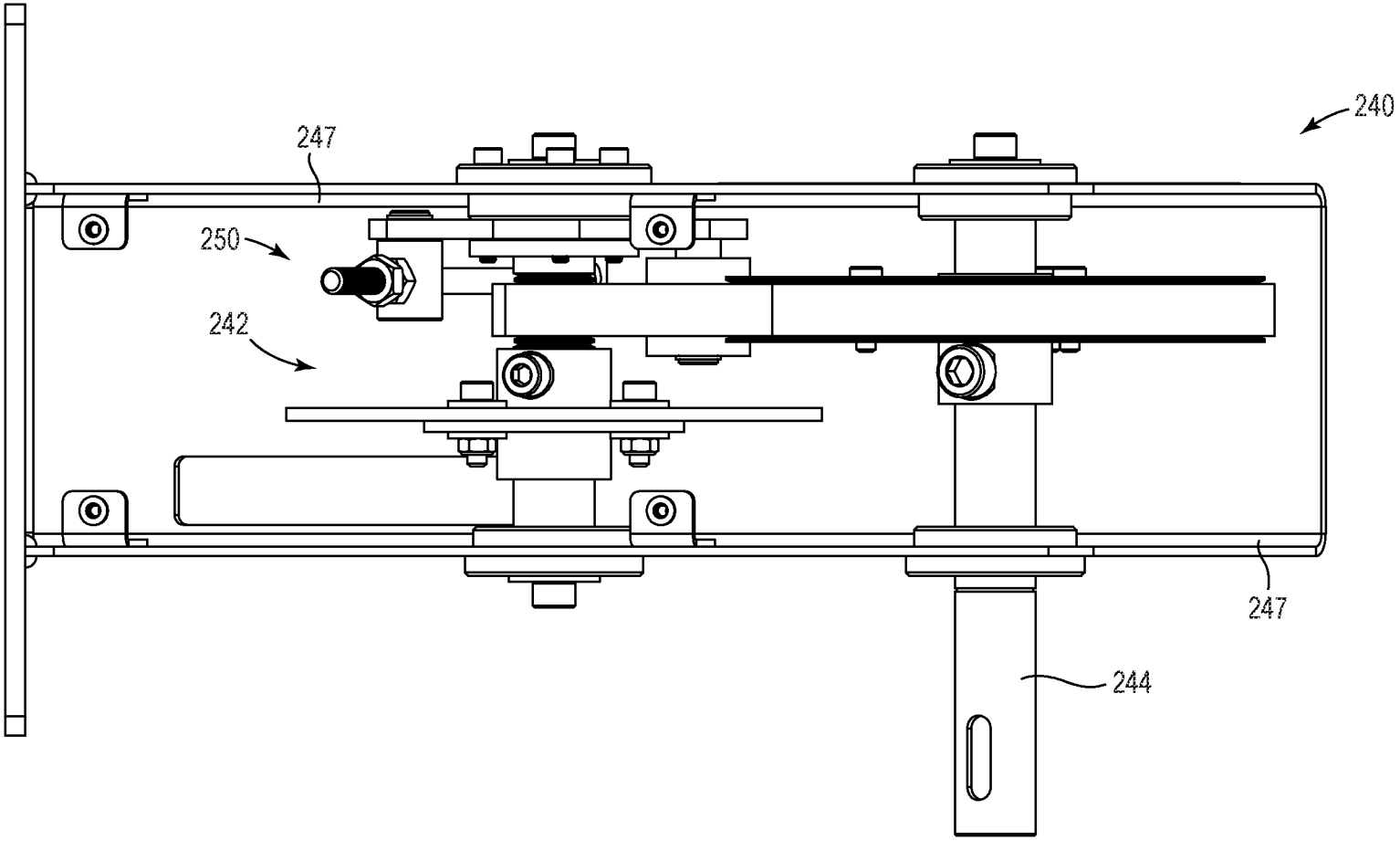
FIG. 24 is a top view of the resistance assembly portion depicted in FIG. 18 sans the resistance adjustment feature and with portions of the housing removed to facilitate viewing of the internal components.
Figure 25:
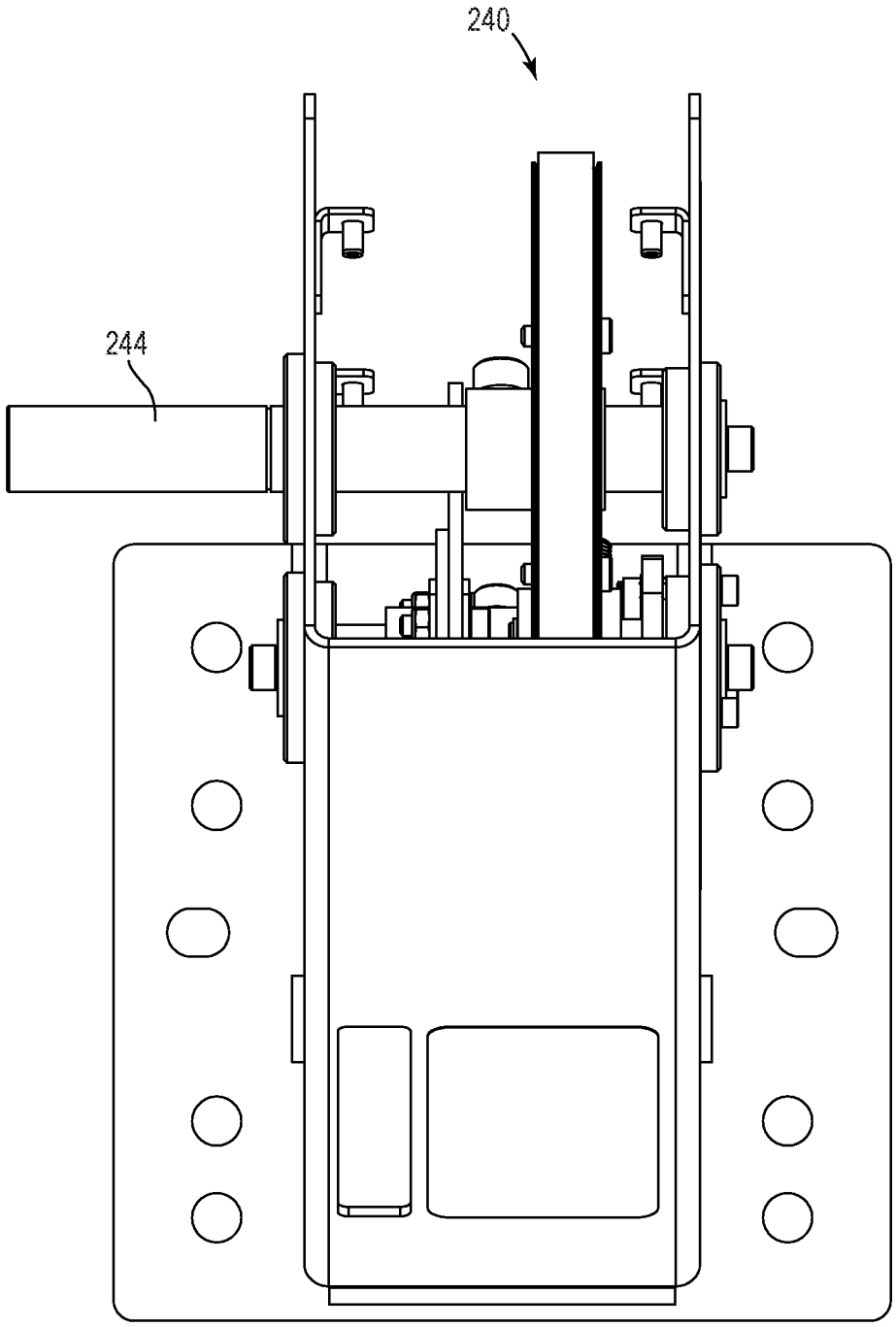
FIG. 25 is a front view of the resistance assembly portion depicted in FIG. 18 sans the resistance adjustment feature.
Figure 26:
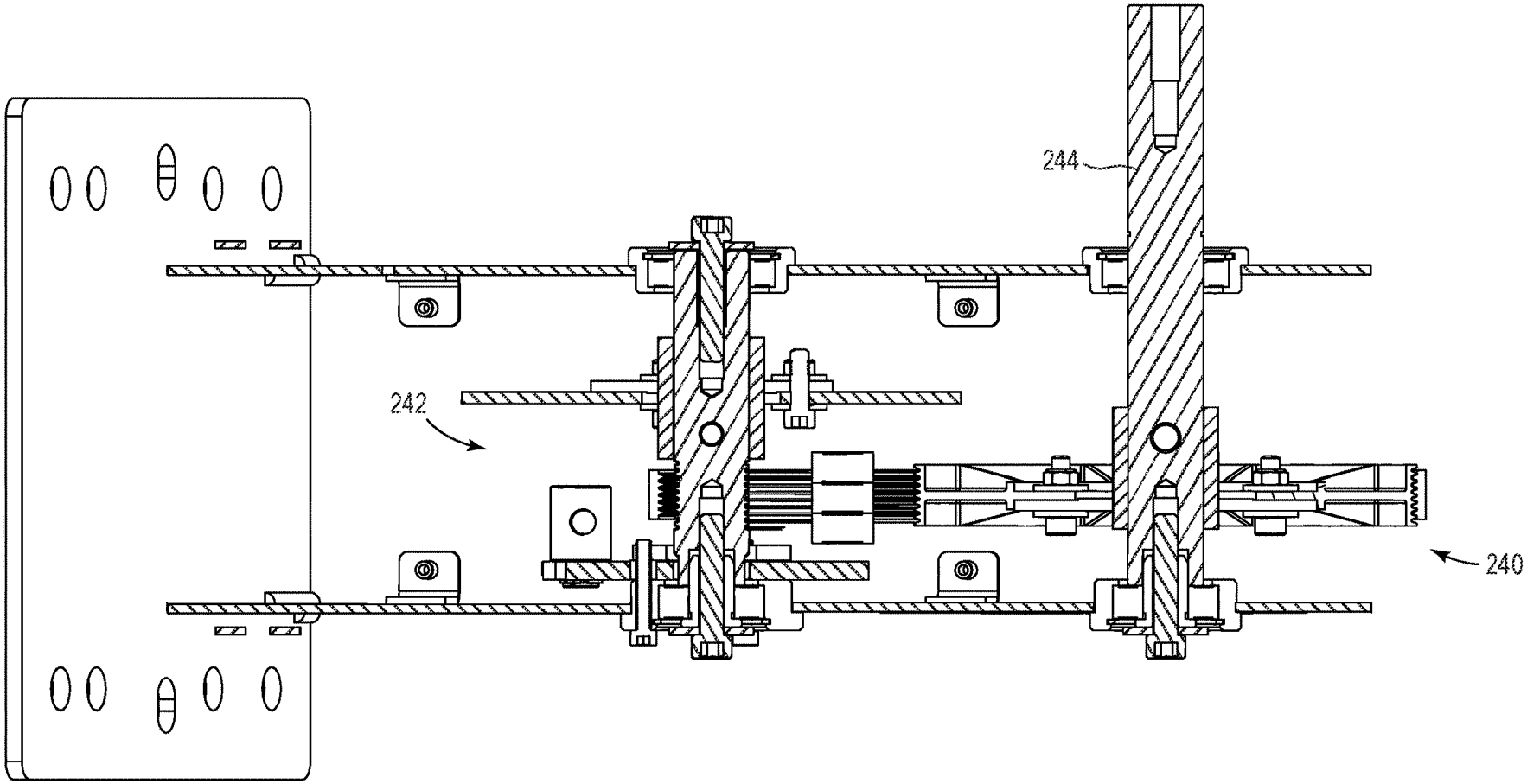
FIG. 26 is a cross-sectional view of the resistance assembly portion depicted in FIG. 22 taken along line 26-26.
Figure 27:
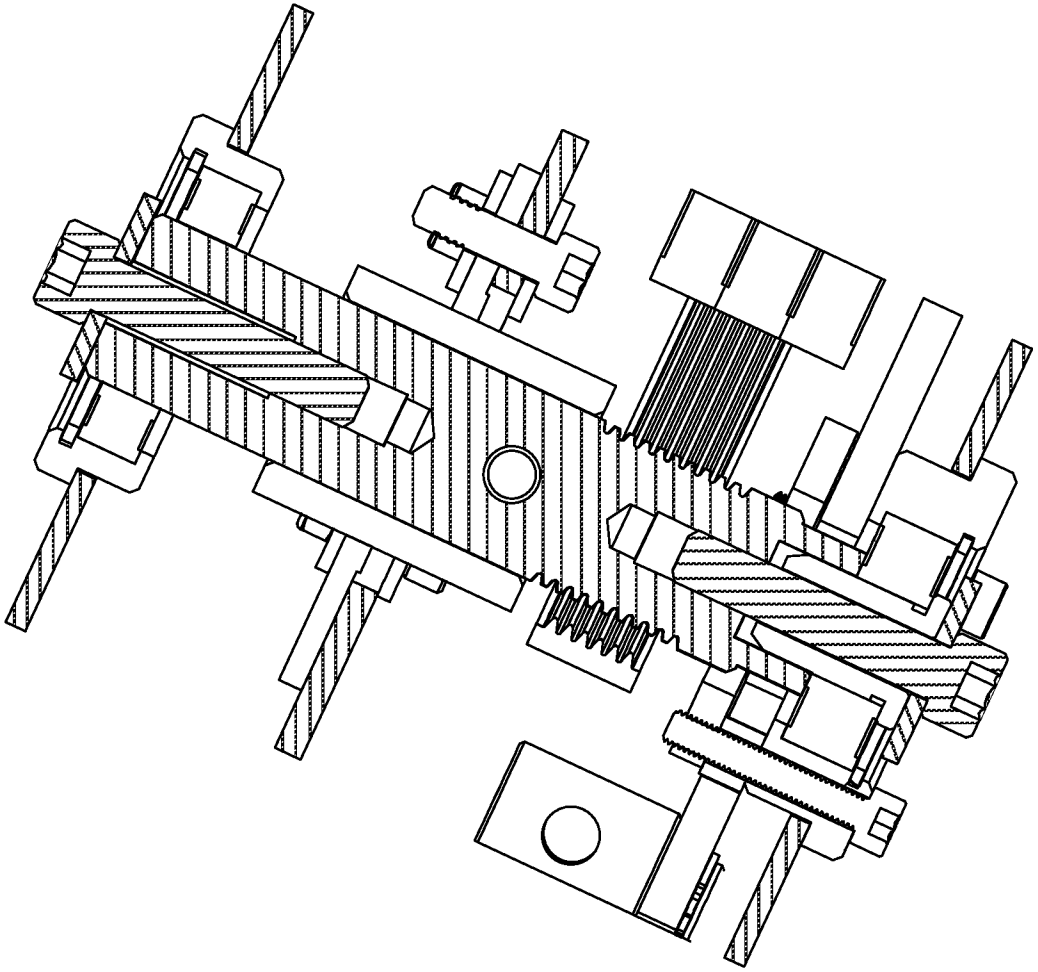
FIG. 27 is a cross-sectional view of the resistance assembly portion depicted in FIG. 23 taken along line 27-27.

Referring to FIGS. 4, 10 and 13, the guide rollers 212 and 213 are configured and arranged for pivoting together as a unit about the drive axis 245 of the drive shaft 244 independently of the drive roller 211. More specifically, the guide rollers 212 and 213 are mounted to a roller assembly housing 227, which in turn is rotatably mounted upon the drive shaft 244 for rotation about the drive axis 245 and rotation about the drive roller 211. The guide rollers 212 and 213 may be statically or rotatably mounted to the roller assembly housing 227.

Comparing FIGS. 1-6 (pulled vertical) with FIGS. 7-12 (pulled at an angle of incline), pulling downward on the endless rope 260 at an angle of incline relative to vertical effects pivoting of the pair of guide rollers 212 and 213 about the drive axis 245 of the drive shaft 244 at an angle commensurate with the angle of incline. Such pivoting of the pair of guide rollers 212 and 213 about the drive axis 245 of the drive shaft 244 at an angle commensurate with the angle of incline maintains a constant wrap angle of contact a of the endless rope 260 on the drive roller 211, even when the angle of incline is greater than 10° relative to vertical.

Referring to FIGS. 1, 2, 7, 8, 14 and 15, the endless rope 260 is entrained or wrapped around the drive roller 211, with a free end 261 positioned proximate ground and defining a slack side 262 which during use returns towards the drive roller 211, and a tension side 263 which during use is pulled by an exerciser away from the drive roller 211. The free end 261 may be either placed under constant tension by a biased pully (not shown) positioned near ground, or allowed to dangle freely from the dynamic head assemblage 200.

Referring to FIGS. 13, 16, 20, 24 and 26, a braking mechanism 242 applies resistance to rotation of the drive shaft 244 and thereby the drive roller 211. Any of the various well-known means for providing such resistance may be employed including specifically but not exclusively, braking motors, generators, brushless generators, eddy current systems, magnetic systems, alternators, tightenable belts, friction rollers, fluid brakes, etc. A braking mechanism 242 capable of providing progressive resistance based upon acceleration or speed of travel is generally preferred.

The braking mechanism 242 is secured to and retained within a resistance assembly housing 247 which is statically attached to the frame 100. The drive shaft 244 is rotatably mounted upon and extends through the resistance assembly housing 247 for rotation about the drive axis 245.

The endless rope trainer 10 preferably includes a resistance adjustment mechanism 250 for adjusting the level of resistance applied to rotation of the drive roller 211. Referring to FIGS. 1, 2, 3, 4, 7, 8, 9, 10, 13, 14, 15, 18 and 19, one embodiment of a suitable resistance adjustment mechanism 250 includes a lever 251 operable for rotation into one of several pivot positions for interacting with the braking mechanism 242 to increase or decrease resistance. A pull chain 252 may be attached to the distal end of the lever 251.

I claim:

1. An endless rope trainer, comprising:

(a) an upright frame, (b) a dynamic head assemblage supported a distance above ground on the upright frame, the dynamic head assemblage comprising:

(i) a drive shaft defining a drive axis, (ii) a drive roller keyed to the drive shaft, (iii) a pair of guide rollers proximate the drive roller configured and arranged for pivoting together as a unit around the drive axis of the drive shaft independently of the drive roller, and (iv) a means of applying resistance to rotation of the drive roller, and (c) an endless rope entrained around the drive roller.

2. The endless rope trainer of claim 1 wherein: (A) the upright frame extends transversely from ground, (B) the drive axis extends laterally, and (C) the pair of guide rollers are longitudinally spaced a fixed distance from one another to define a fixed distance longitudinal gap between an outermost circumferential periphery of each guide roller comprising the pair of guide rollers.

3. The endless rope trainer of claim 2 wherein the drive roller has a diameter measured at an axial midplane of the drive roller and a longitudinal gap between the outermost circumferential periphery of each guide roller comprising the pair of guide rollers is less than the diameter of the drive roller.

4. The endless rope trainer of claim 2 wherein the pair of guide rollers are configured and arranged relative to the drive roller so as to provide and maintain a wrap angle of contact of the endless rope on the drive roller of at least 200°.

5. The endless rope trainer of claim 1 wherein the drive axis is spaced at least 8 feet above the ground.

6. The endless rope trainer of claim 1 wherein the endless rope dangles freely from the dynamic head assemblage.

7. The endless rope trainer of claim 1 further comprising a means for adjusting the level of resistance applied to rotation of the drive roller.

8. The endless rope trainer of claim 1 wherein pulling downward on the endless rope at an angle of incline relative to vertical effects pivoting of the pair of guide rollers about the drive axis of the drive shaft at an angle commensurate with the angle of incline.

9. The endless rope trainer of claim 1 wherein pulling downward on the endless rope at an angle of incline of greater than 10° relative to vertical effects pivoting of the pair of guide rollers about the drive axis of the drive shaft at an angle commensurate with the angle of incline in the absence of any change in the wrap angle of contact of the endless rope on the drive roller.

10. The endless rope trainer of claim 1 wherein each guide roller comprising the pair of guide rollers are rotatable.

11. The endless rope trainer of claim 1 wherein the drive roller has a diameter measured at an axial midplane of the drive roller of between 3 and 12 inches.

12. An endless rope trainer, comprising:

(a) a base, (b) a stanchion extending vertically from the base, (c) a boom extending horizontally from the stanchion, (d) a dynamic head assemblage coupled to a distal end of the boom, the dynamic head assemblage comprising:

(i) a drive shaft defining a drive axis, (ii) a drive roller keyed to the drive shaft, (iii) a pair of guide rollers proximate the drive roller configured and arranged for pivoting together as a unit around the drive axis of the drive shaft independently of the drive roller, and (iv) a brake for applying resistance to rotation of the drive roller, and (e) an endless rope entrained around the drive roller.

* * * * *